United States Patent [19]

Gelhard

[11] Patent Number: 4,458,512

[45] Date of Patent: Jul. 10, 1984

[54] CYLINDER LOCK WITH KEY FOR MECHANICAL AND/OR ELECTROMECHANICAL LOCKING

[76] Inventor: Egon Gelhard, Thomas-Mann-Str. 10, D-5000 Koln 51, Fed. Rep. of Germany

[21] Appl. No.: 355,929

[22] Filed: Mar. 8, 1982

[30] Foreign Application Priority Data

Mar. 6, 1981 [DE] Fed. Rep. of Germany ..... 3108476

[51] Int. Cl.[3] ..... E05B 47/00

[52] U.S. Cl. ..... 70/277; 70/408; 70/411

[58] Field of Search ..... 70/277–278, 70/382, 408, 411, 413, 431, 434, 441, DIG. 49, 364 A, 364 R; 340/149 R, 149 A; 361/171

[56] References Cited

U.S. PATENT DOCUMENTS

| | | | |
|---|---|---|---|
| 3,347,072 | 10/1967 | Rose | 70/277 |
| 3,408,838 | 11/1968 | Katz | 70/277 |
| 3,639,906 | 2/1972 | Tritsch | 340/149 |
| 3,686,659 | 8/1972 | Bostrom | 340/149 |
| 4,198,552 | 4/1980 | Tahara | 70/434 |
| 4,287,733 | 9/1981 | Gomez-Olea | 70/382 |
| 4,317,156 | 2/1982 | Stangl | 361/171 |
| 4,326,125 | 4/1982 | Flies | 70/277 |

FOREIGN PATENT DOCUMENTS

| | | | |
|---|---|---|---|
| 475532 | 3/1915 | France | 70/408 |

*Primary Examiner*—Robert L. Wolfe

*Attorney, Agent, or Firm*—Collard, Roe & Galgano

[57] ABSTRACT

The invention relates to a cylinder lock with a key for mechanical and/or electromechanical locking or electrical signal emission with codeable locking means and devices which influence or generate electrical currents. The device includes a cylinder housing with a cylinder core carrying the locking bit and a continuous keyway with conduits discharging therein for core platelets (wafers), whereby the key and locking conduits are provided with mutually cooperating and codeable mechanical devices and devices which influence or generate and electrical currents for mechanical and/or electromechanical locking, or for other given signal triggering. The device is characterized in that the mechanical devices for actuation or for triggering the mechanical locking each form a corresponding structural unit for coding within the keyway and in the key, together with the electrical/electronic devices for the electromechanical locking or signal triggering.

11 Claims, 5 Drawing Figures

CYLINDER LOCK WITH KEY FOR MECHANICAL AND/OR ELECTROMECHANICAL LOCKING

The invention relates to a lock cylinder designed as a profile-installation-single and double cylinder with emergency and danger functions for dead locks with pin locking means, for example, for door locks in the dimension of DIN 18252, whereby a mechanical locking can be actuated by means of the key bit and which can be simultaneously used by the electronic structured signal parts for a further locking and/or control and/or for controlling of alarm devices. It can also be used for attachment cylinders and central locking devices.

From the patent and technical literature, mechanically and electrically/electronically operable locking devices are known which are controllable only partially by the manufacturer and partially by the user. Thereby, the coding is carried out by exchanging mechanical and electrical structural elements in the key, as well as in the lock housing. This coding to be carried out by the user is difficult and requires the highest concentration and is also expensive and complicated in making, due to the many individual elements.

It is therefore an object of the invention to offer the user a simple, rapid and safe coding of the mechanical part as well as the electrical part of the locking device and, above all, to find a structural solution which enables the use and transfer of the subject matter of the invention to profile-installation-lock cylinders.

In order to obtain the project of the invention, a cylinder lock with a key is provided for mechanical and/or electromechanical locking or electrical signal emission with codable mechanical locking means and means for influencing or generating electrical currents, which includes a cylinder housing with the cylinder core carrying the locking bit and a continous keyway with conduits discharging therein for core platelets or wafers. The key and locking conduits are provided with mutually cooperating, exchangeable and codeable mechanical devices and means which influence or generate electrical currents for effecting mechanical and/or electromechanical locking, or for other given signal triggering. The mechanical devices for actuation or for triggering the mechanical locking each form a corresponding coded structural unit within the keyway and in the key, together with the electrical/electronic devices for the electromechanical locking or signal triggering.

In particular, the solution of the invention consists in that in the key two "teeth" which are combined into one unit are exchanged. These two "teeth" are electrically insulated from each other, while simultaneously forming the contacts for the electrical structural element connected in series (for example, resistor, condensor, coil, transistor or diode, active and passive, of any given type) which are integrated into the exchangeable unit.

Therefore, only the core pins which correspond to the teeth have to be exchanged in the cylinder core. By separating the key into a key body with a mountable or displaceable key head, it is possible to code double cylinders differently at both sides and to actuate it with only one key.

The following main advantages are present:

1. The code units for the mechanical and electrical coding are combined into one element.

2. Only the corresponding core pins for effecting the mechanical locking have to be exchanged in the cylinder core.

3. The simultaneous coding of mechanical and electrical structural elements results in a hitherto unachievable variation and therefore safety, due to the use of the full installation width of the double cylinder with twelve mechanical locking means and six electric/electronic structural elements.

4. Due to the peculiarity of the key (the separation into a key body and key head), which enables an equidirectional insertion of the key body into the keyway from left or right (inside or outside), it is possible to design a unitary cylinder core without the need for coupling or connecting separate right and the left halves which is rather advantageous in light of durability and structural cost (the dreaded "nominal breakage location" of the known profile lock cylinders is eliminated).

5. Since the key body, the cylinder core as well as the cylinder housing are made of non-conductive material, for example, plastic with a high durability and consistency, it is not necessary to insulate the "conductive paths" for the electric coding members and contact elements.

6. By color coding a pair of exchangeable "pair of teeth" and "core platelets", a simple, easy, unmistakeable coding is made possible by the user.

The subject matter of the invention can be transferred to single or plural axis locking devices and is not limited to profile lock cylinders, for example, mounting locks, safe lock devices, container locks.

Other objects and features of the present invention will become apparent from the following detailed description considered in connection with the accompanying drawings, which disclose several embodiments of the invention. It is to be understood that the drawings are to be used for the purposes of illustration only, and not as a definition of the limits of the invention.

In the drawings, wherein similar reference characters denote similar elements throughout the several views.

Figure 1:
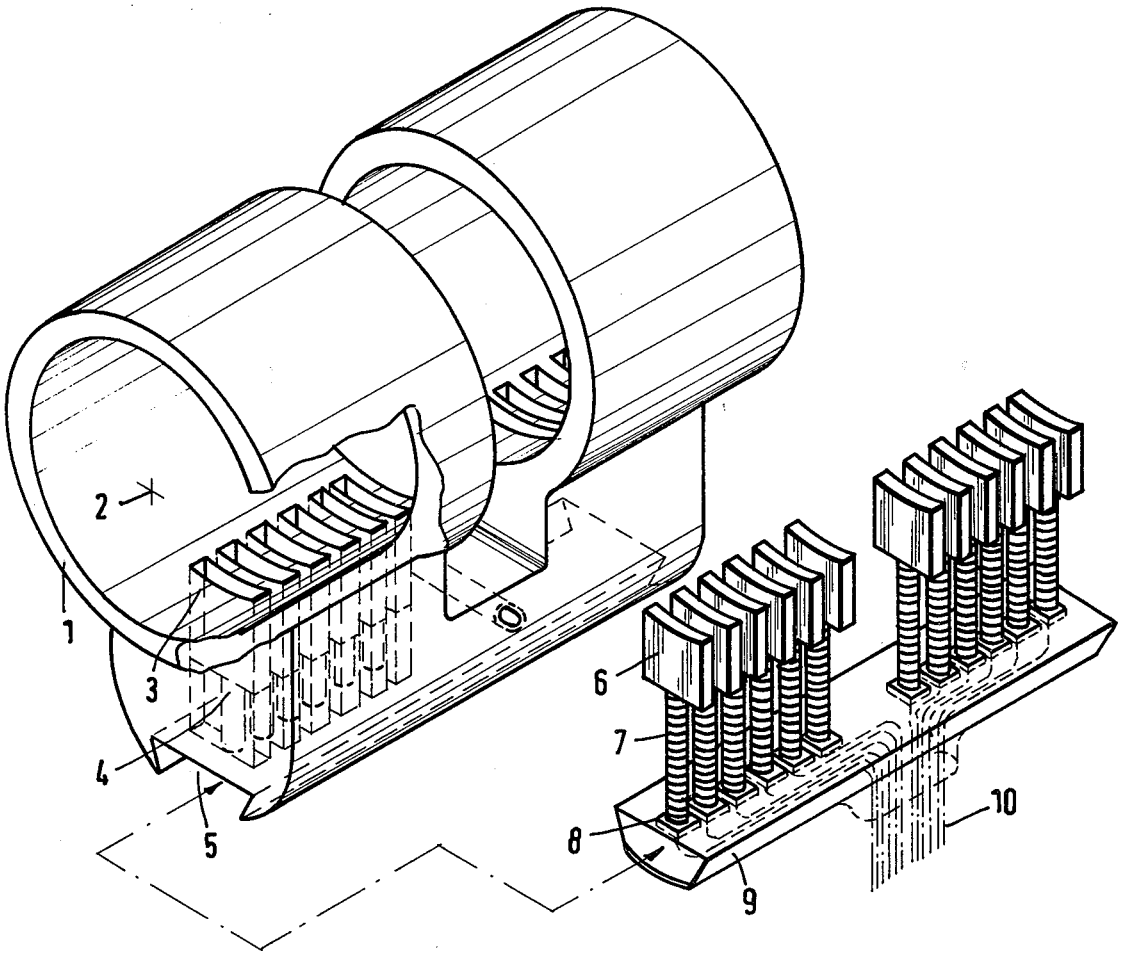
FIG. 1 is a schematically-illustrated, exploded perspective view of a cylinder housing, further showing certain of the elements to be installed therein.

Referring now in detail to the drawings, as can be seen in FIG. 1, a cylinder housing 1 is provided having a smooth central bore 2 for a cylinder core and rectangular conduits or channels 3 for the core elements mounted on both sides in the cylinder housing 1. These rectnagular conduits also have pocket-like recesses 4 for the housing platelet springs.

The rectangular conduits for the core elements discharge into the conduit 5 for the contact slide 9 through which the core tumblers or platelets 13 and the housing tumblers or platelets 6 are introduced, compressed by cylinder pressure springs 7, which, in turn, are supported by contact platelets 8 which are imbedded in locking slide 9 and soldered to the cables 10.

Figure 2:
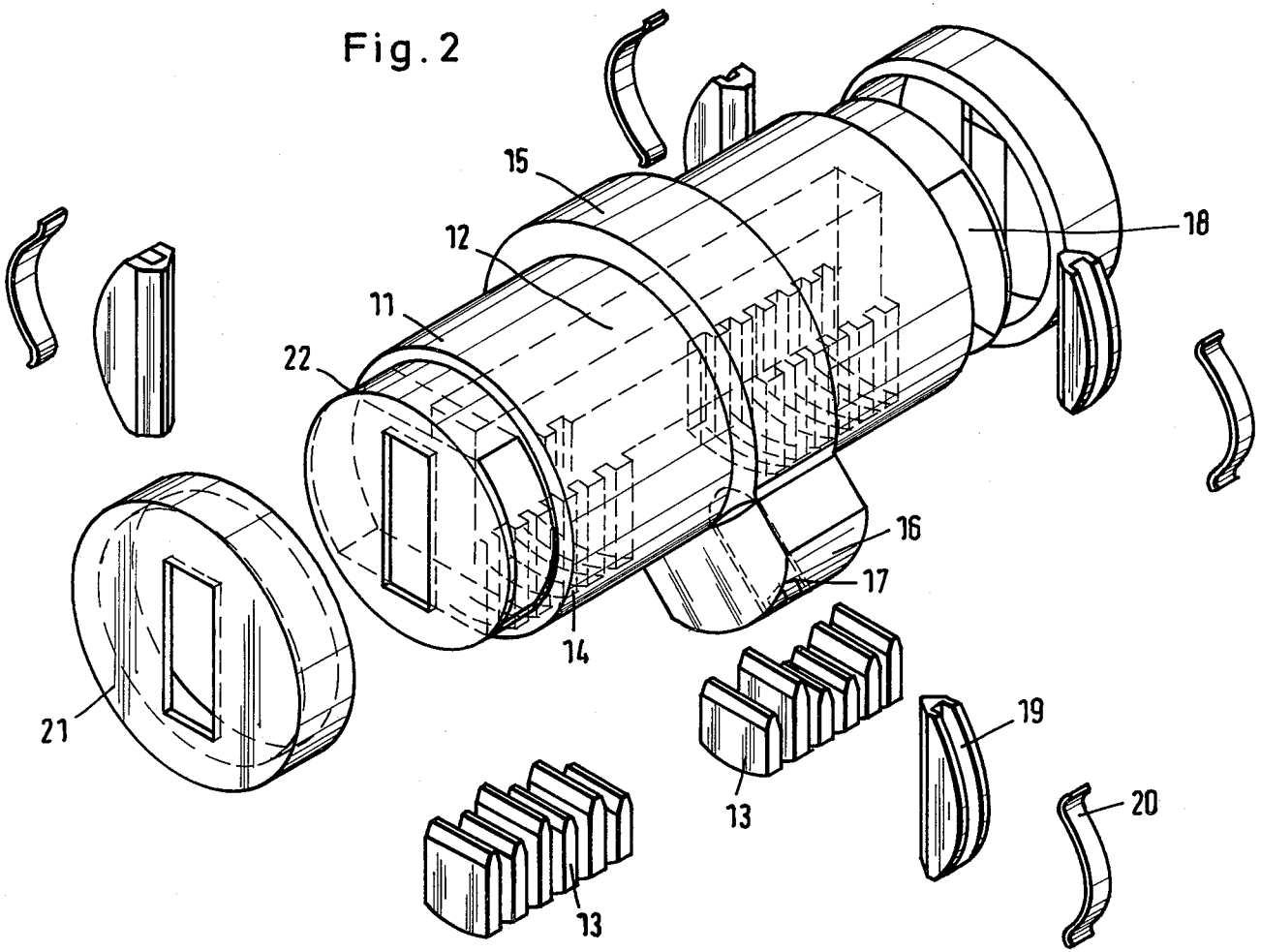
FIG. 2 is a schematically-illustrated, exploded perspective view of the continuous, non-separated cylinder with its installation elements and with a keyway cover device disposed at both sides of its keyway.

The rectangular continuous keyway 12 is centrally positioned in the unitary cylinder core 11 (FIG. 2) in whose rectangular conduit 14 the core platelets 13, which act as locking devices, are moved by inserting the key in such a manner that, in the release position, their curve-like or arcuate lower edges are flush with the surface of the core 11 or its cross-sectional shape.

When introduced into the cylinder housing (FIG. 1), the locking bit ring 15, with the attached locking bit 16, is moved over the cylinder core 11 and both are positively connected with cylinder 11 by means of a set screw 17, for example.

Slide conduits 18 are provided within cylinder 11 on both sides of keyway 12. Two slides 19 move within each slide conduit 18 and are biased into a center position to cover the keyway 12 by two sliding springs 20, so that the keyway is blocked when the key is removed.

The support of the slide springs 20 and the covering of the slide conduits 18 is afforded by two caps 21, which are pressed onto opposite shoulders 22 of cylinder core 11.

Figure 3:
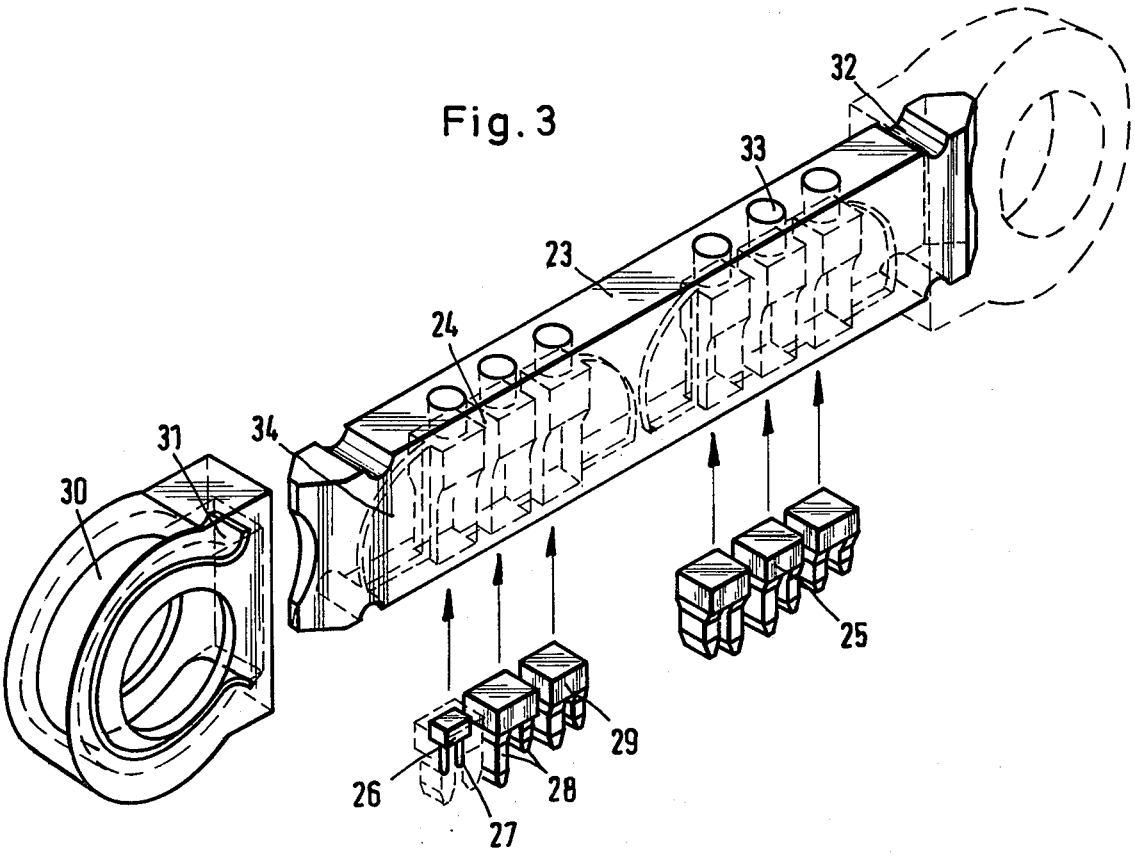
FIG. 3 is a schematically-illustrated, exploded view of the key with installation parts and key head which can be mounted on both sides thereof.

The key in accordance with FIG. 3 consists of the actual key body 23 having a plurality of pockets 24 in which the code units 25 are inserted by the manufacturer and/or user. These code units consist of the electric or electronic structural element 26 having a pair of electrically conductive connecting wires 27 on each of which a tooth segment 28 of different height is electrically-conductively secured and a pentahedral injection molding 29 made of insulating plastic.

The key body 23 becomes operable by a key head 30 which is mountable on either end thereof and which is fixed by a leaf spring 31 installed therein, which engages into a recess 32 of key body 23.

Bores 33 which are provided centrally above pockets 24 make it possible to remove the code units 25 from the key body 23 with a small pin and replace them with other code units. This removal and insertion is facilitated by a longitudinal slot 34 which enables the flanks of the key body to be slightly spread apart.

Figure 4:
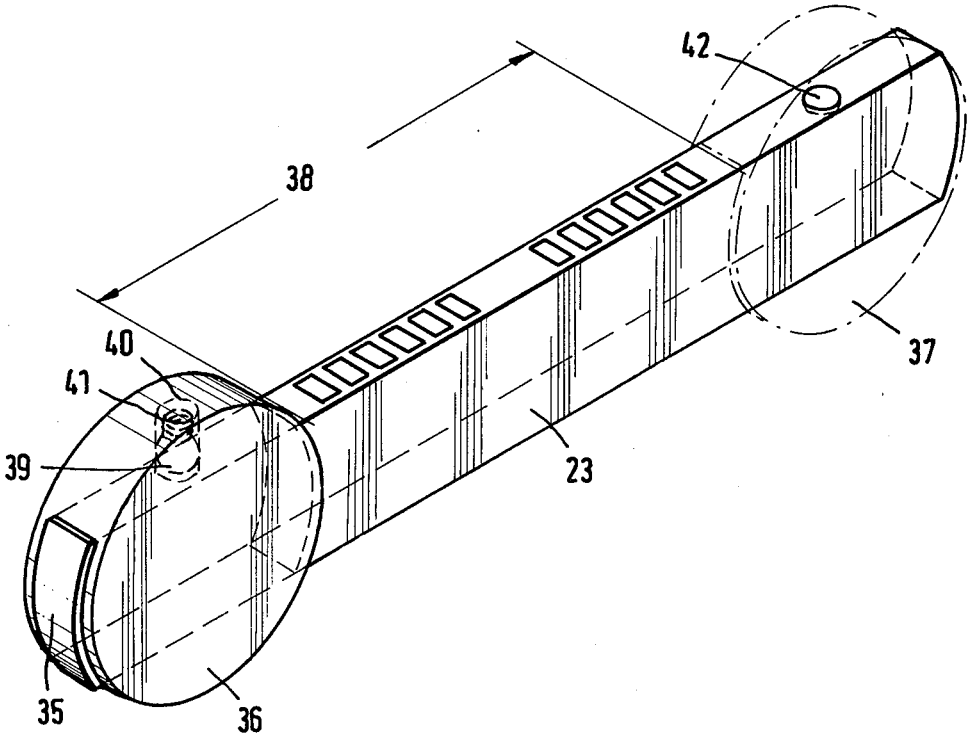
FIG. 4 is a schematically-illustrated perspective view (not to scale) of a master key with a longitudinally-displaceable key head.

As can be seen from FIG. 4, the key body 23 can be made operable by a key head 30 which is provided with a conduit for key body 35, so that the head 30 can be moved into a front position 36 or into a rear position 37, so that a useable key length 38 remains exposed. An engagement ball 39 is guided in a bore 40 within key head 30 and it serves to fix the key head via the force of a spring 41 in a ball recess 42 in key body 23.

Figure 5:
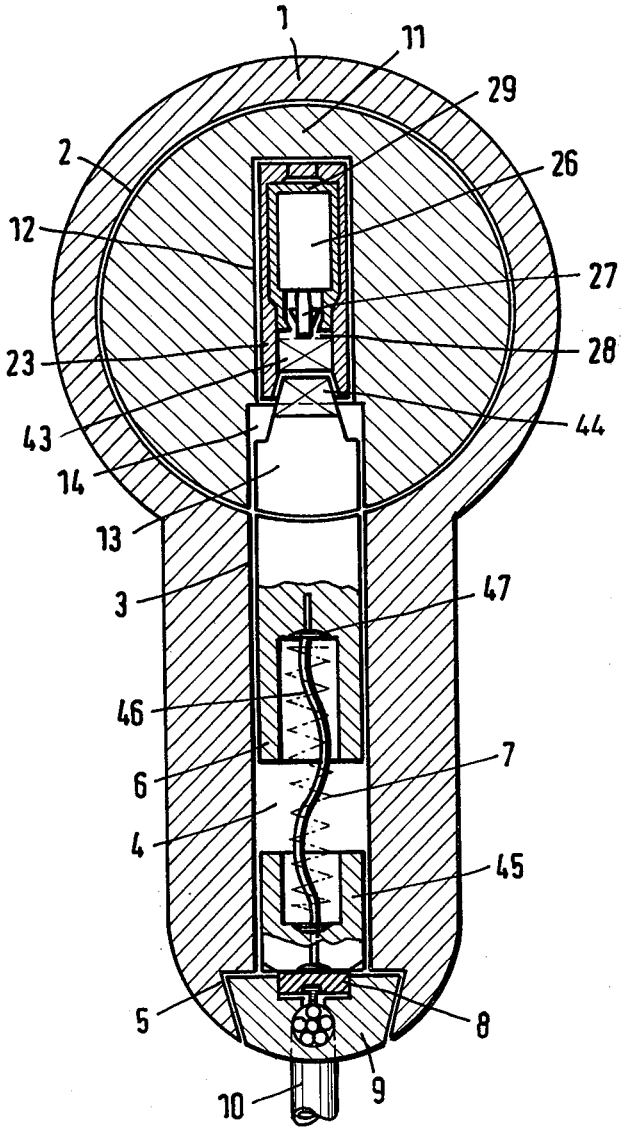
FIG. 5 is an enlarged, cross-sectional view through a lock cylinder in the release position thereof.

The cylinder core 11 is rotatably mounted with some free play within the central bore 2 (FIG. 5), in whose keyway 12, key body 23 is inserted in the shown cross section.

This cross-sectional view taken also through the key body 23, shows the position and disposition of the electric or electronic structural element 26 on whose connecting wires 27 the tooth segments 28 are mounted in an electrically-conductive manner. The elements 26, 27 and 28 are encompassed by sheath 29.

These tooth segments are provided with oblique flank faces 43 directed normally with respect to the direction of the longitudinal axis of the key and they correspond to and oppose the flank faces 44 of core platelets 13.

The housing platelets 16 within rectangular conduit 3 are pushed against the core platelets 13 by means of the cylinder pressure spring 7, and form the electrical current path via the connecting cable conductor 46 of the electrical or electronic element 26, via core platelets 13, housing platelets 6, and base contact piece 45 to the contact platelet 8 within the locking slide 9, and to cable 10; the connecting locations 47 permitting a low-loss current transmission.

While only a single embodiment of the present invention has been shown and described, it will be obvious to those persons of ordinary skill in the art, that many changes and modifications may be made thereunto, without departing from the spirit and scope of the invention.

What is claimed is:

1. A cylinder lock and key assembly for mechanical locking and electrical signal emission with codeable locking means and devices which influence or generate electrical currents, comprising:

a key;

a cylinder housing;

a cylinder core mounted within said housing, said core having a locking bit coupled thereto which serves to fix said core in said housing and a continuous keyway extending therethrough, said core also having a plurality of conduits discharging into said keyway; and said key and conduits being provided with mutually cooperating, interchangeable and codeable mechanical means and means for influencing or generating electrical currents for effecting mechanical locking and for other given signal triggering, said mechanical means for actuation or for triggering the mechanical locking each form corresponding coded structural units within the keyway conduits and in said key together with the electrical/electronic devices for signal triggering.

2. The assembly of claim 1, wherein said mechanical locking means form current paths for the electric/electronic devices for coding.

3. The assembly of claim 1, wherein said cylinder core is a unitary cylinder core, wherein said core conduits are rectangular and each has a core platelet mounted therein, and wherein said housing has a plurality of corresponding rectangular conduits each having spring-loaded housing platelets mounted therein which cooperate to serve as said mechanical locking means, and wherein said assembly additionally includes a channel formed in said cylinder housing, a locking slide slideably mounted in said channel, a plurality of contact platelets mounted on said slide which support said housing platelets and a cable which is connected to said contact platelets.

4. The assembly of claim 1, wherein the locking bit ring with said coupled locking bit is initially disposed over the cylinder core, and is finally connected with the cylinder core by means of a set screw.

5. The assembly of claim 1, wherein said core platelets are designed for a curve-like contact location for a fine adjustment and for more progressive ratios.

6. The assembly of claim 1, wherein a slide conduit is provided on both sides of said cylinder housing at opposite ends of said keyway, wherein a pair of spring-loaded, moveable slides are mounted in each of said slide conduits for movement between an open and closed position relative to the keyway, in the latter of which the keyway is closed when the key is removed.

7. The assembly of claim 6, wherein the ends of said cylinder core each protrude outwardly from said housing to define a shoulder, and wherein said assembly additionally includes a pair of protective caps which cover said slide conduits and support said spring-loaded slides said caps each being pressed onto an opposite shoulder of said cylinder core.

8. The assembly of claim 1, wherein said key comprises an elongated, longitudinally-extending key body having a plurality of transversely-extending pockets in each of which one of said structural units is received, and wherein each structural unit comprises an electrical/electronic element having a pair of connecting wires on each of which is mounted in an electrically conductive manner a tooth segment of different height and a pentahedral-sided coating made of insulating plastic.

9. The assembly according to claim 8, additionally including a key head which is releasably mounted on one end of said key body, said ends of said key body each having a recess formed therein, and said key head having a leaf spring coupled thereto disposed for releasable engagement with one of said recesses of said key body.

10. The assembly of claim 8, additionally including a key head having a channel extending therethrough, slidably mounted on said key body with said key body extending through said channel thereof, so that said key head is displaceable into a front position at one end of the key body, and a rear position at the opposite end of the key body, with a usable key body length remaining exposed therebetween, and wherein a ball recess is provided in said key body at each end thereof and wherein said key head has a bore opening onto said channel thereof and a spring-loaded engagement ball mounted in said bore, which serves to releasably engage said ball recess, and fix said key head, under the force of said spring loading, on said key body.

11. The assembly of claim 8, wherein said cylinder housing, said cylinder core and said key body are made of non-conductive plastic material.

* * * * *